United States Patent [19]

Attema

[11] Patent Number: 4,493,516

[45] Date of Patent: Jan. 15, 1985

[54] ELECTRICAL DUCTING SYSTEM

[76] Inventor: Gijsbertus Attema, Dillenburgstraat 1, Gorinchem, Netherlands

[21] Appl. No.: 452,297

[22] Filed: Dec. 22, 1982

Related U.S. Application Data

[63] Continuation of Ser. No. 164,241, Jun. 30, 1980, abandoned.

[30] Foreign Application Priority Data

Jul. 2, 1979 [NL] Netherlands ..... 7905150
Oct. 1, 1979 [NL] Netherlands ..... 7907278

[51] Int. Cl.[3] ..... H01R 25/14
[52] U.S. Cl. ..... 339/21 R; 339/33
[58] Field of Search ..... 339/20, 21, 22, 23, 339/24, 258, 33

[56] References Cited

U.S. PATENT DOCUMENTS

| | | | |
|---|---|---|---|
| 1,805,572 | 5/1931 | De Mask | 339/21 R |
| 1,869,145 | 7/1932 | Greis | 339/21 R |
| 2,317,964 | 4/1943 | O'Brien | 339/23 |
| 3,546,367 | 12/1970 | Hart et al. | 339/21 R |
| 3,900,240 | 8/1975 | Bertrams et al. | 339/21 R |
| 4,105,099 | 8/1978 | Bertrams et al. | 339/22 T |

FOREIGN PATENT DOCUMENTS

| | | | |
|---|---|---|---|
| 1393233 | 2/1965 | France | 339/21 R |
| 1435160 | 3/1966 | France | 339/21 R |

*Primary Examiner*—Neil Abrams

*Attorney, Agent, or Firm*—Beehler, Pavitt, Siegemund, Jagger & Martella

[57] ABSTRACT

A ducting system comprising ducts of mainly U-shaped cross-section with bare hollow conductors fitted at the inner surfaces thereof, which conductors are accessible for corresponding contact pins of a contact element to be locked in arbitrary points on the open side of a duct, auxiliary parts being used for interconnecting such ducts and connecting a duct with a current supply. The improvement is that the conductors each consist of a continuous elastic metal strip bent into a mainly closed tube with oppositely bent outer rims, which conductors are retained in an insulating and non-rotatable manner in interior channels having a narrow access slot allowing a contact pin to be inserted through a slot into the narrow opening of the conductor in question between the outwardly bent outer rims, the adjacent bends of the conductor then being lateraly displaced so as to clamp the sides of the contact pin under spring tension and to make electrical contact therewith, interconnecting pins being used for interconnecting corresponding conductors of aligned ducts or a conductor of a duct and a corresponding conductor of an auxiliary part, these pins having a diameter which is larger than the smallest diameter of a hollow conductor in the unstressed state, so that such a pin, when inserted axially into the extremity of a conductor will be elastically clamped by inner wall portions of the conductor making electrical contact therewith.

4 Claims, 14 Drawing Figures

ELECTRICAL DUCTING SYSTEM

Figures 1, 7:
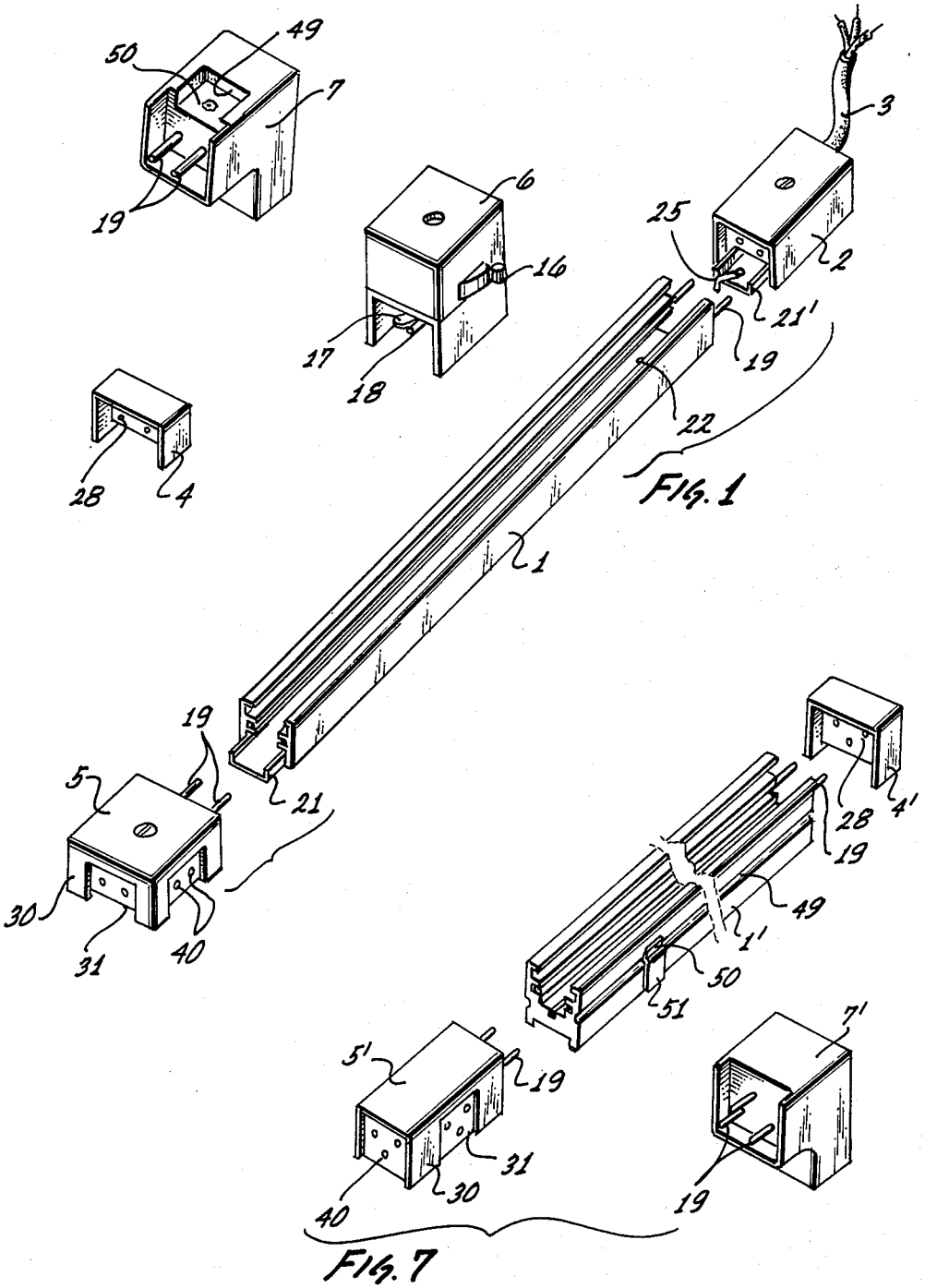

This is a continuation of application Ser. No. 164,241, filed June 30, 1980, now abandoned.

Recently many ducting systems have been proposed comprising one or more ducts in which a number of mainly bare conductors are supported in an insulated manner. To these ducts contact parts can be connected, branchable in arbitrary points, and provided with contact pins which can be connected to corresponding conductors in a duct.

An important advantage is that in this manner the contact parts, which can be produced for instance as a carrier for a lampholder or for a socket outlet can be placed at any given point in the duct, and that such contact parts can be added or removed as required. Naturally this is of advantage for the installation of lamp holders in living, office, shop, or exhibition rooms. As the installation of such ducts is very simple and as, moreover, the ducts contain all the desired conductors, it may be of advantage, when considering the installation costs, to use such ducts for the installation or replacement of electrical wiring in existing buildings, in particular when labour costs for the installation of conventional wiring in conduit tubing or cables become too high.

The known ducting systems can be subdivided in two groups, namely, on the one hand, those in which the conductors are situated parallel to each other on the bottom surface of a U-shaped duct and/or arranged in a more or less rigid flat cable, and, on the other hand, those ducts in which the conductors are placed on the side walls of a U-shaped duct. In the first case a contact part provided with contact pins can be inserted in the duct or on the cable whereby the contact pins are brought into contact with the conductors. In the second case the contact part must be provided with contact pins which can be turned outward, and which, after insertion in the duct, can be brought into contact with the laterally fixed conductors, at the same time locking the contact part onto the duct.

Further the conductors can be subdivided into two kinds, namely mainly solid conductors, the contact pins of the contact parts then being brought into contact with the surface of the conductor and then, in most cases, the pins must be kept under spring tension, and, on the other hand, hollow conductors with a longitudinal channel into which the contact pins can be inserted, the rims of a channel then clenching the sides of the contact pins resiliently.

These known ducting systems have several disadvantages. Often the bare conductors are easily accessible from the outside so that the ducts provided with them must be installed outside normal reach, and use of them as skirting ducts or the like is not possible. Systems exist in which this accessibility is reduced, but these require relatively costly insulation sheathings or flat cables. A disadvantage of the solid bare conductor is that the contact surface of the pins of a contact part is relatively small, and that these contact pins have to be kept under considerable spring tension in order to keep the contact resistance to a minimum, whereas moreover oxide layers on the conductors or on the contact pins can influence the contact resistance unfavourably. In the case of hollow conductors the resiliently outwardly bent rims of the channel provide the required contact pressure when the contact pin is inserted, whereas, when inserting or removing a conductor, possible oxide layers are scraped off, but also in this case the contact surface is relatively small whereas the spring force of such a hollow conductor is insufficient to maintain the contact pressure continuously when contact parts are repeatedly inserted and removed.

The invention aims at providing such a system which does not have the disadvantages of the known systems and which, moreover, can be manufactured in a relatively cheap way.

The ducting system in accordance with the invention comprises one or more ducts of mainly U-shaped cross-section with bare conductors fixed in an insulated way to the inner surfaces of the duct, contact parts which can be inserted through openings into the duct and which can be locked onto the duct by means of a movable bolt, to which contact parts contact pins are connected which, at insertion or locking, are brought into contact with a corresponding conductor, and connecting parts by means of which a connection can be made between the conductors of a duct with supply cables or with corresponding conductors in another duct, which system in accordance with the invention is characterised in that each conductor consists of a continuous strip of an elastic conducting material, in particular phosphor-bronze, which strip is bent into a mainly closed tube of which the end rims are bent back outwardly, all of which in such a way that the inner surfaces of the thus obtained outward bends are, in the unstressed state, at a distance of each other which is smaller than the thickness of a contact pin of a contact part, and, when bent open by a contact pin or such-like, will clench the sides thereof, and in that on the inner surfaces of the ducts channels have been formed in each of which a conductor fits tightly, which channels are in communication with the interior of the duct by means of a narrow continuous slot, the width of which corresponds with the thickness of a contact pin of a contact part, the cross-section of these channels being such that the conductors fit therein without being able to be turned, and the outwardly bent rims of the conductors being situated symmetrically in respect of the narrow slot. In particular the ducts are made of plastic so that the conductors can be inserted into the channels of these ducts without additional insulation.

As the conductors are placed in channels which are only connected to the interior space of the duct by means of a narrow slot with a width of, for example, not more than 2 mm, these conductors are not directly accessible, whereas these conductors can be inserted into the channels of the ducts in a very simple way, and are kept fixed by their own elasticity. The particular shape of these conductors further assures that they are always placed in the correct position in the corresponding channel, whereas the lateral contact with an inserted contact pin is sufficient under all circumstances and is kept under a sufficient spring tension, which spring tension is maintained under all circumstances by the particular shape of these conductors. Because the contact surfaces of these conductors are rounded, the insertion of contact pins is considerably simplified as the roundings having a directional effect so that no damaging of the conductors can occur which can happen with the conventional hollow conductors. When the ducts are made entirely of plastic, no additional insulation means need be used. To make an electrical coupling with such a conductor, coupling pins can be used which are inserted longitudinally into the inner opening of this conductor, which coupling pins have such a thickness that the conductors are sufficiently bent open to guarantee a good contact with these pins. These pins may form part of a coupling part for mutually coupling longitudinally aligned ducts, and to form branches coupling boxes can be used provided with mutually crossing internal connections by means of which contact sockets or pins at different sides of the box are connected with each other, which connections are formed, in particular, by cross-shaped contact strips situated at different levels so as to remain free of each other, whereas additional filling plates can be used by means of which the position of these strips is further determined.

In particular the bottom of the duct can be provided, opposite to the opening of the duct, with a channel with an earth or neutral conductor, in which case the conductors inserted in the channels of the side walls serve as current carrying or switchable conductors.

It is also possible to provide a metal stiffening rod in the bottom of the duct which can also serve as earth connection, means then being provided to couple these rods of different ducts to each other, said rods then being accessible within the ducts for making earth connections.

For fixing such ducts they can be provided with recesses, in particular on or near the bottom surface, adapted to be engaged and clamped by mounting parts to be fixed on a support.

The contact part by means of which a connection with such a duct can be effected in arbitrary points comprises a contact body which can be inserted into the interior of the duct and which is provided with laterally projecting contact strips which, when the contact body is turned, are swung into the conductor channels and then are brought into contact with the conductors therein, which contact body is, moreover, provided with laterally projecting locking lugs which can grip behind a rim of the duct. This body is in particular provided with longitudinal recesses into which flat conductor strips can be inserted provided at one extremity with wire clamps with which they can be kept fixed on the body, whereas the other extremity, which protrudes beyond the body, can be bent at right angles after insertion and is then suitable for being brought into contact with the conductors.

This contact body can, furthermore, be provided at its free end with an additional contact which can be inserted into a channel on the bottom of a duct or else can be brought into contact with a there situated stiffening strip.

As such a duct complies with the most stringent safety requirements because the conductors therein are not accessible due the narrow access slots, which narrow slots have become possible because the conductors, due to their particular shape, lie symmetrically in respect of the slot in the channel, and through the rounding of the contact surfaces will adjust themselves to the contact pins, such ducts can be installed also in accessible positions, in particular at skirting or window sill height and vertically on walls, so that there is also a need for a corner piece by means of which ducts, fixed to walls which form right angles, can be interconnected, which corner piece is, again, provided with contact sockets and/or pins allowing a simple connection with the conductors of the joined ducts to be formed, whereas, if needed, additional means for through-connecting the stiffening strips can be present.

Figure 2:
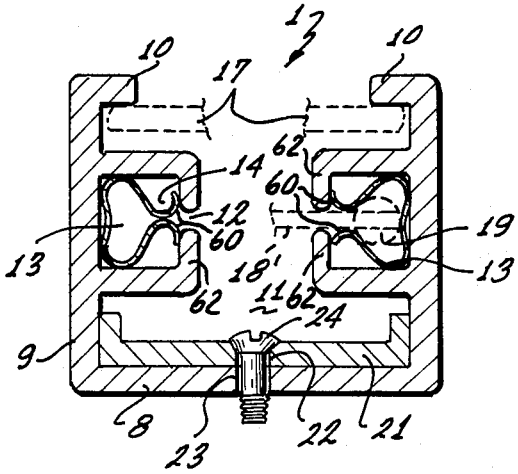
Figure 4:
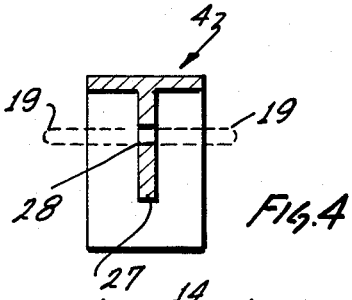
Figure 3:
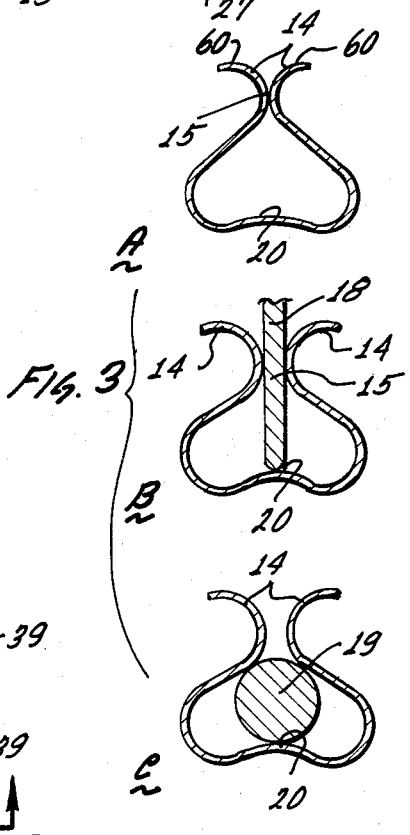
Figure 5A:
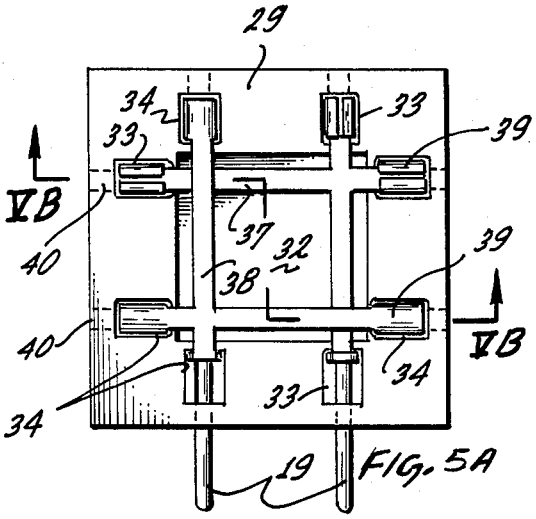
Figure 6:
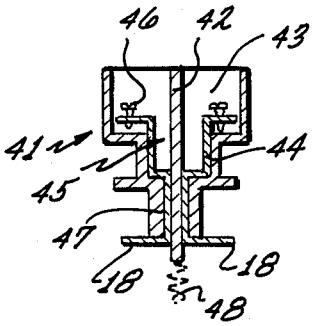
Figure 8:
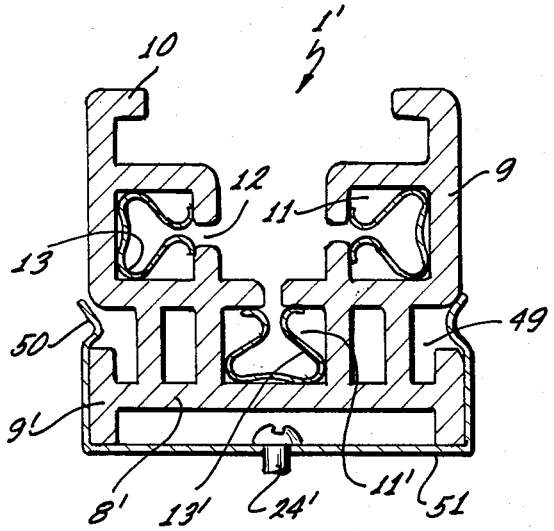
Figure 9A:
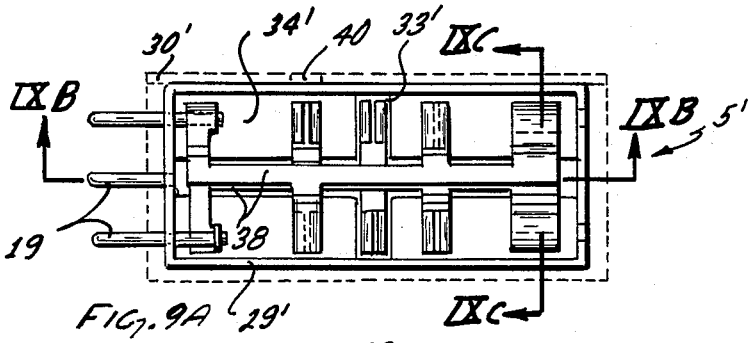

The invention will be further explained in the following by reference to a drawing, showing in:

FIG. 1 is an isometric representation of the various parts of the system according to the invention;

FIG. 2 a cross-section at a larger scale of a duct provided with conductors of this system;

FIGS. 3A, B and C cross-sections at a still larger scale over the conductors of such a duct in the unstressed state and in the state after the insertion of a contact pin or a coupling pin respectively;

FIG. 4 a section over a coupling part for mutually connecting longitudinally aligned ducts;

FIGS. 5A and B a top view and a cross-section respectively of a connection box for making connections between ducts at right angles to each other;

FIG. 6 a simplified section over the major part of a contact part for such a system;

FIG. 7 an isometric representation corresponding to FIG. 1 of some parts of another embodiment of the system in accordance with the invention;

FIG. 8 a cross section corresponding to FIG. 2 of a duct of the system in accordance with FIG. 7; and FIGS. 9A, B and C a view in plan and two sections of a connecting box for the system of FIG. 7.

In FIG. 1 the major parts of the system in accordance with the invention are shown in isometric view. These parts comprise a duct 1, a connecting box 2 for making a connection with a supply cable 3, a connecting part 4 for connecting two aligned ducts 1, a branching box 5 for forming a connection between ducts 1 at right angles, a contact part 6 by means of which a connection between an apparatus and a duct 1 can be effected, and a corner connecting piece 7 for forming connections between ducts 1 fixed to supporting surfaces at right angles.

The duct 1, shown in FIG. 2 in cross section on a larger scale, consists of plastic, and has a mainly rectangular U-shaped section with a bottom 8, lateral walls 9 and inwardly directed end rims 10. To the inside of each lateral wall 9 a mainly closed channel 11 is formed which is laterally accessible by means of a continuous narrow slot 12. Naturally, also more of such channels can be provided to a lateral wall when the dimensions of the duct allow this. In each channel 11 a conductor 13 made of phosphor-bronze or similar well conducting and elastic material is placed. Such a conductor is shown separately on a still larger scale in FIG. 3A.

The conductor 13 is, as is illustrated, bent into a nearly closed tube having a generally onion shaped cross section of which the edges 14' are bent away outward, as best shown in FIGS. 3A–3C, the dimensions being such that the conductor is fitting tightly in the channel 11, and the edges 14 are situated symmetrically in respect of the continuous slot 12. Furthermore, the bends 15, connected to the edges 14, engage each other under spring pressure. The free edges 14 can deflect sufficiently siedwards when the conductor is bent outward by a contact pin or such like, these edges then remaining mainly symmetrical in respect of the continuous slot 12.

As seen in FIG. 2, the convex lip surfaces 60 are closley adjacent or in contact with the flanges 62 which define the narrow axis slot 12. As may be readily appreciated from FIG. 2, the lips of the onion shaped conductor are movable into contact with the flanges upon attempted rotation of the conductor within its rectangular channel, thereby stopping such attempted rotation.

The making of a contact with such a conductor is illustrated on the right in FIG. 2 and on a large scale in FIGS. 3B and C. When a contact part 6 is placed on the duct 1, a contact body can be turned by means of an external operating part 16, as will be further described below, which body is provided with locking lugs 17, of which one is shown in FIG. 2, which can each grip behind a terminal rim 10 of the duct 1 in order to lock the part 6 onto the duct. Moreover this body carries contact pins 18 which, when the contact body is inserted in the duct 1, will lie opposite the slots 12, and on rotation of this body will be swung into the slot. As is apparent from FIG. 2 (right-hand part) and FIG. 3B, the insides of each bend 15, which have been pushed apart by the, particularly bevelled, edge of the contact pin 18, come into contact with the respective side surface of this pin, whereby a good contact with the whole side of this pin is obtained. Furthermore this pin 18 can be made in such a way that, in the outswung position, its end surface comes into contact with the opposite inner surface of the conductor 15 as shown in FIG. 3B.

Further, for making a connection with the conductors 13, round connecting pins 19 can be used which, as is also apparent from the right-hand part of FIG. 2 and from FIG. 3C, are inserted lengthwise into a conductor 13 at its free end, the thickness of such a pin 19 being chosen in such a way that the sides of the conductor 13 are sufficiently bent outward to obtain a tight gripping contact. The central part 20 of the conductor 13 can be slightly bent inward, as shown in FIG. 3C, to guarantee also a good gripping at this point.

In both cases the deflection of the conductor 13 takes place in such a way that only the edges 14 are shifted sideways against the inner surface of channel 11 at both sides of the slot 12, the deformation then being distributed over the whole section in such a way that no overloading will take place so that the elasticity will always be maintained. As, furthermore, the conductor cannot turn, the edges 14 will continue to move symmetrically in respect of the slot 12, and the roundings 15 facilitate the insertion of a contact pin 18.

The connecting pins 19 can, for example, be loose pins which, as is shown in FIG. 1, are inserted into the conductors 13 at the end of a duct 1 in order to form a connection with the connecting box 2. As the box 2 should be connected to a supply cable 3, it is not allowed to supply this box itself with fixed pins, and this part must be provided with recessed contact sockets into which the pins 19 will fit.

Further the duct 1 is provided with a metal stiffening rod 21 fitting between the bottom 8 and the undersides of the channels 11 and which, in particular, can be provided with raised sides. This stiffening rod 21 assures an effective stiffening of the plastic duct 1 thus avoiding damage thereof. The rod 21 can be provided with holes 22 at regular distances. The holes 22 can be positioned opposite holes 23 in the duct bottom 8 after which connecting screws 24 can be passed through these holes in order to screw the duct onto a supporting surface. The holes 23 can be executed, in particular, as areas of reduced thickness in the bottom 8 which can be pierced as required, and it is also possible to drill the holes 23 in the bottom 8 as required the holes 22 of the rod 21 then serving as a template.

As is illustrated in FIG. 1, the rod 21 can be shifted with respect to the duct 1 so that an end of it protrudes beyond the end surface of the duct 1. This protruding end can then be inserted into a part positioned in the extension of the duct 1. In FIG. 1 the connecting box 2 is provided with a corresponding protruding part 21' which is inserted in the adjoining end of the duct 1 and which, as is shown, is provided with a contact spring or contact lip 25 by means of which an electrical connection with the rod 21 in the duct 1 can be effected, if necessary by making use of an additional screw. It is, of course, also possible to have the rod 21 protruding at the other end, and then to insert the protruding end into the body of box 2 so as to form a mechanical joint between the two, and at the same time an electrical connection be formed. Such a connection is needed if the system has to be provided with a continuous earth connection for which the rod 21 can be used. As, however, all parts, and in particular the contact part 6, can be made of plastic, a so-called double insulated construction is possible, and then the earth connection is often superfluous.

The simple connecting part 4 is represented in section at a larger scale in FIG. 4, and it serves for the coupling of ducts 1 when positioned in each other's extension. For that purpose it would suffice to use only the loose pins 19 which are inserted in corresponding conductors 13 of both ducts, and the the protruding part of the stiffening rod 21 of the one duct would serve for the alignment. However, the part 4 provides insulation against creep currents and at the same time the joint between adjoining ducts is covered, for example against the introduction of a knife which then could touch the conductors. This part comprises a U-shaped cap 26 with a centrally placed partition 27 with two holes 28 into each of which a double connecting pin 19 fits and can be fixed if necessary. The partition 27 does not reach down to the underside of the cap 26 in order to allow passage of a protruding part of the stiffening rod 21. Also when such a coupling is used, the rods 21 of interconnected ducts 11 can be connected electrically by means of a contact spring or a screwed contact clip.

Figure 5B:
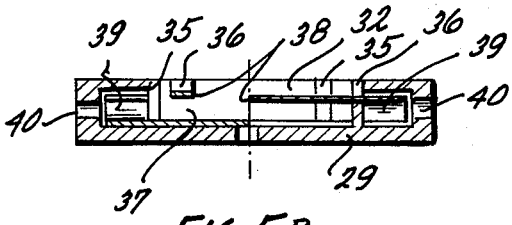

The branching box 5 is illustrated in FIG. 5. This part comprises a housing 29 which can be convered with the lid 30, only shown in FIG. 1, which lid is provided at the sides with openings or pierceable access ports 31. The housing 29 comprises a square central cavity 32 communicating at each side with two chambers 33 resp. 34. Access from the chambers 33 to the cavity 32 is by means of a deep passage 35, and the chambers 34 have access to the cavity 32 by means of a shallow passage 36. This housing is provided with two asymmetric cross-shaped connecting conductors 37 and 38 resp., which cross each other at different levels and are punched out of sheet metal. Three of the four free ends of of each conductor are widened and bent into elastic contact sockets 39, whereas the fourth end of each conductor is set at right angles to which end a fixed contact pin 19 is riveted. Thereby these contact sockets 39 fit in the corresponding chambers 33 and 34 resp., which chambers communicate further with openings 40 in the outer wall of the housing, and the pins 19 protrude through corresponding holes 40 towards the outside. As follows clearly from FIG. 5B, the conductors 37 and 38 are thus kept apart at different levels, and, if necessary, a small insulated plate can be inserted between the two. This plate can be provided with additional lugs to keep the conductors in their right position, for that matter these lugs can also be provided to the lid 30 or to a cover plate. It will be clear that the sockets 39 can also be provided at all four extremities of the conductors in which case again loose connecting pins 19 can be applied. The housing 29 has, in the illustrated case, a smaller height than the lid 30, so that under the housing a space remains free for accommodating protruding parts of stiffening rods 21 or similar coupling parts, which can be inserted into the adjoining ducts 1. It will be clear that the housing 29 can also be executed in such a way that earth connections between the rods 21 can be effected within this housing.

FIG. 6 shows a simplified schematic section of the internal contact body of the contact part 6. This body 41 is made of plastic and comprises a connecting chamber 43 divided into two parts by a partition 42 and two passages 44 at either sides of the partition 42. Contact strips 45 are provided at one extremity with connecting screws 46, the straight parts 47 of the strips 45 then being passed through corresponding passages 44 and, beyond those, are bent outward flat against the end surface of the body 41. These bent extremities thus form the contact pins 18. Further the body 41 is provided with the actuating part 16. The end surface of the body 41 can, if necessary, be provided with a resilient contact 48 which can be connected to an earth conductor and which can be in contact with the rod 21.

The corner connecting piece 7 serves for making a connection between ducts 1 mounted on walls which are at right angles to each other. Also this part comprises on at least one side contact pins 19 and at the other side corresponding contact sockets, and also at two sides contact sockets can be provided. In the case as illustrated a recess 49 is available into which a stiffening rod 21 of a duct 1 fits, and further an earth contact 50 is shown schematically by means of which a connection between an internal earth connection and this rod can be formed. A similar connection can be available at the other side. It is, of course, also possible, as shown for the connecting box 2, to use a protruding earth contact which can be inserted into the adjoining duct.

In FIGS. 7–9 a second embodiment of the system in accordance with the invention is shown, in which corresponding parts are indicated with the same reference numbers as in FIGS. 1–6. The parts shown in FIG. 7 correspond mainly with those of FIG. 1, whereby for simplicity's sake the connecting box 2 and the connector 6 have been omitted.

The duct 1' of FIG. 7 is represented in FIG. 8 in cross-section at a larger scale. This one differs from the duct 1 of FIGS. 1 and 2 in that also in the centre of the bottom 8 a channel 11' is formed in which a conductor 13' is situated. The latter can be used as earth lead, but it is also possible to use it as a common lead, and to use the conductors 13 in the lateral channels 11 as phase conductors for two different groups, which can, if required, be switched on and off at will by corresponding switches.

An other difference is that recesses 51 have been made in the lateral walls 9. In these recesses fit the resilient extremities 52 of spring clips 53 which can each be fixed to a support by means of a fixing screw 24', after which a duct 1' can be snapped into the clips. The bottom 8' of the duct is now slightly recessed with respect to the bottom edges 9' of the walls 9 so as to create space for the head of the screw 24'. It is also possible to provide inwardly turned rims to the bottom edges 9' behind which a resilient spring clip could engage, in which case the fixing will be invisible from the outside. It will be clear that this method of fixing can also be applied to the duct of FIG. 2, whereas also in the case of FIG. 8 a stiffening rod 21 can be provided which should, of course, be insulated from the conductor 13'.

The part 4' shown in FIG. 7 differs from the part 4 of FIGS. 1 and 4 in that now holes for three pins 19 are provided in the partition 27. When the conductor 13' serves as earth conductor, the connecting part 4 of FIG. 4 may be used, and then the pins 19, serving for the earth connection, are inserted below the partition 27.

The corner connecting piece 7' of FIG. 7 only differs from part 7 of FIG. 1 by the presence of three pins 19 at one side and three corresponding sockets at the other side.

In FIG. 9 a branching box 5' is shown in plan and in section. Its housing 29' has approximately the same width as a duct 1' so that the cover 30', indicated in broken lines, which is a bit larger than the housing 29', can slightly overlap an adjoining duct. This housing contains a deep longitudinal chamber 32' communicating in the centre with two deep transversal chambers 33' whereas shallow side chambers 34' are situated above these chambers.

In the chambers 32' and 33' a symmetric cross-shaped connecting conductor 37' is resting on the bottom of these chambers, and in the upper part of chamber 32' and in the side chambers 34' two asymmetrical cross-shaped conductors 38' are situated. These conductors 38' are identical in shape but have been turned 180° along their longitudinal axis in respect to each other, as is clearly evident from FIG. 9C. Because the parts of these conductors which project laterally from the central part are offset in the manner shown, the central parts can stay separated from each other. The upper conductor 38' rests thereby on lugs 54. Further the cover can be provided with inwardly directed lugs which can come into contact with the various parts of these conductors in order to secure these conductors in position. Of course insulated spacing plates, if needed provided with lugs, can be used to improve the separation between the different conductors.

Figure 9B:
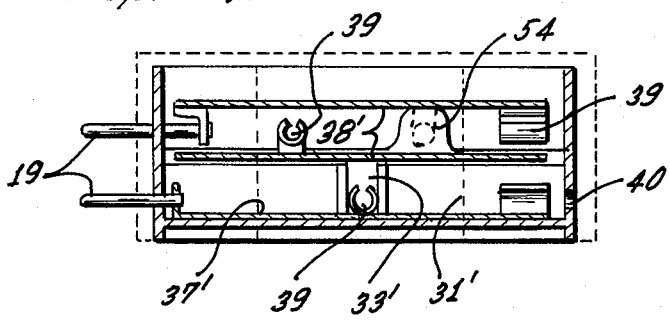
Figure 9C:
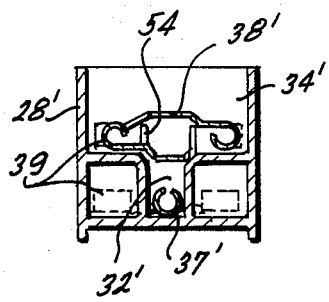

The above mentioned conductors 37' and 38' consist again of metal strips with the extremities bent round to form contact sockets 39, and at one extremity contact pins 19 have been fixed. The contact sockets are situated opposite holes 40 in the side wall respectively end wall of the housing 29', and the side walls of the cover, as shown in FIG. 9B, can be provided with an opening 31 which opening corresponds with the shape and dimensions of a duct 1'.

It will be clear that also in the case of the embodiment of FIG. 1 such a branching box can be used, in particular when the stiffening rods 21 are provided with appropriate connecting means.

The contact part 6 of FIG. 6 can be adapted for the system of FIG. 7 by fixing the central part 42 rigidly in the enveloping housing, and then the remaining parts of the body 41 can rotate around this central part. The central part can then be provided with a passage into which a flat contact pin fits which, when the part 6 is inserted into a duct 1, penetrates into the channel 11', and then makes contact with the conductor 13' therein. This already takes place before the other contact pins come into contact with the corresponding conductors 13 which is desirable with an earth condition.

It will be clear that within the scope of the invention many modifications are possible.

In particular the present system can be adapted for 3-phase alternating current by arranging two channels 11 at each lateral wall 9, the conductors 13 in three of the four channels 11 being used as phase conductors and the fourth as the neutral conductor. The fifth conductor 13' (FIG. 8) or 21 (FIG. 2) is, again, grounded. The contact parts 6 should, then, be provided with four laterally extendable contact pins 18. At least the rims 10 of the ducts 1 should be made asymmetrical so as to ensure that a contact part 6 will always be inserted in the correct position in respect of the different phase conductors.

I claim:

1. In an electrical current supply duct having one or more insulating channels of substantially rectangular cross section including a bottom, a pair of side walls, a pair of flanges defining a narrow access slot into said insulating channel, and a current conductor mounted within each said insulating channel, the improvement comprising:

each of said current conductors being a hollow tubular structure of resilient electrically conductive material, said tubular structure having a pair of curved lips terminating in upper edges outward of said tubular structure and spaced from and extending towards said side walls, each lip having a convex surface facing one of said flanges, each said convex surface being movable into contact with one of said flanges upon attempted rotation of said conductor, said tubular structure having side portions curving outwardly to contact with said side walls and a bottom portion contacting the bottom of said insulating channel at least at two spaced apart points, to thereby restrain said conductor against movement within the insulating channel by said contact with the bottom, side walls and flanges of said channel, said lips being resiliently spreadable from each other so as to make spring contact with an electrical contact pin inserted either between said opposing convex surfaces or axially into said conductor, said conductor strip being held against rotation within said insulating channel by coaction between said side lobes, said spaced apart points and said lips with said side walls, said bottom and said flanges respectively of said insulating channel.

2. The device of claim 1 wherein said ducts and said insulating channels are entirely formed of insulating material such as plastic.

3. The improved conductor of claim 1 wherein said bottom portion of the conductor includes a concave portion defining an internal third convex surface between said spaced apart points such that a pin inserted axially into said conductor makes spring contact with said opposing convex surface and also said third convex surface.

4. The electrical supply duct of claim 1 wherein said duct is of substantially U-shaped cross section forming an open longitudinal channel including a bottom and a pair of side walls, said one or more insulating channels being formed in said side walls and communicating with said open channel through a continuous narrow longitudinal slot overlying said pair of curved lips of the conductors, the bottom of said duct also being provided with an insulating channel formed therein and a strip of conductive material positioned in said bottom channel.

* * * * *